US005287868A

United States Patent [19]

Tuller et al.

[11] Patent Number: 5,287,868

[45] Date of Patent: Feb. 22, 1994

[54] DISHWASHER CONVECTION AIR INLET AND SUDS CONTROL DEVICE

[75] Inventors: Barry E. Tuller; Thomas M. Johnson, both of Newton, Iowa

[73] Assignee: Maytag Corporation, Newton, Iowa

[21] Appl. No.: 19,763

[22] Filed: Feb. 19, 1993

[51] Int. Cl.[5] ..... B08B 3/02

[52] U.S. Cl. ..... 134/95.2; 134/102.3; 134/56 D; 134/200

[58] Field of Search ..... 134/56 D, 57 D, 58 D, 134/155, 186, 95.2, 102.3, 182, 183

[56] References Cited

U.S. PATENT DOCUMENTS

| | | | |
|---|---|---|---|
| 1,452,710 | 4/1923 | Schmelzer | 134/56 D |
| 2,335,641 | 11/1943 | Buckley . | |
| 2,631,448 | 3/1953 | Garman . | |
| 2,871,082 | 1/1959 | Karg et al. . | |
| 3,023,757 | 3/1962 | Mixon . | |
| 3,026,628 | 3/1962 | Berger, Sr. et al. . | |
| 3,126,024 | 3/1964 | Jellies | 134/186 X |
| 3,126,898 | 3/1964 | Duncan | 134/182 X |
| 3,130,737 | 4/1964 | Jellies | 134/186 X |
| 3,294,110 | 12/1966 | Rauszer . | |
| 3,356,431 | 12/1967 | Martiniak . | |
| 3,362,139 | 1/1968 | Williamson . | |
| 3,387,382 | 6/1968 | Williamson . | |
| 3,387,388 | 6/1968 | Williamson . | |
| 3,739,145 | 6/1973 | Woehler | 134/57 D X |
| 3,807,420 | 4/1974 | Donselman et al. | 134/102.3 |
| 4,180,095 | 12/1979 | Woolley et al. | 134/57 D X |
| 5,076,306 | 12/1991 | Suzuki | 134/95.2 |
| 5,167,248 | 12/1992 | Tuller | 134/57 D |

*Primary Examiner*—Frankie L. Stinson

*Attorney, Agent, or Firm*—Zarley, McKee, Thomte, Voorhees & Sease

[57] ABSTRACT

A convection air inlet and suds control device is provided for a dishwasher. The dishwasher has a washing chamber with a bottom wall, a chimney extending through the bottom wall with opposite upper and lower ends positioned on opposite sides of the bottom wall. A chimney cap is spaced in covering relation over the upper end of the chimney. A container having an inner cup and an outer cup is mounted adjacent the bottom wall such that the inner cup surrounds the lower extension of the chimney. The outer cup includes an opening such that air may flow by convection into the outer cup, into the inner cup and upwardly through the chimney into the washing chamber so as to dry the articles in the dishwasher. In oversudsing conditions, the suds flow downwardly through the chimney for collection in the inner cup. Excess suds filling the inner cup will spill over into the outer cup. The inner cup and lower extension of the chimney cooperate to function as a valve. When liquid deriving from condensing suds in the inner cup rises to a level above the lower end of the chimney, downward flow of suds into the inner cup and upward flow of air through the chimney is prevented. As the liquid evaporates to a level below the lower end of the chimney, the flow of air and suds returns to normal.

13 Claims, 3 Drawing Sheets

DISHWASHER CONVECTION AIR INLET AND SUDS CONTROL DEVICE

BACKGROUND OF THE INVENTION

Many dishwashers utilize a convection air system for drying the dishes, glasses, cups, utensils and the like that are washed within the washing chamber. For maximum efficiency, the air inlet for the drying system is normally located at the lowest location in the washing chamber. However, placement of the air inlet at such a location exposes the inlet to water splashing and sudsing. Suds, or foam, can be caused from combinations of food soils and detergents, or by use of a laundry or low grade dishwasher detergent. Suds in the washing chamber can accumulate to a depth of nearly one foot, and will be forced through any openings in the lower portion of the washing chamber.

SUMMARY OF THE INVENTION

A primary objective of the present invention is to provide an improved dishwasher convection air inlet.

Another objective of the present invention is the provision of a dishwasher suds control device.

Still another objective of the present invention is the provision of a dual purpose dishwasher convection air inlet and suds control device.

A further objective of the present invention is the provision of a dishwasher convection air inlet which can be retrofit to an existing washing chamber.

Still a further objective of the present invention is the provision of a container for receiving excessive suds from the washing chamber.

Another objective of the present invention is the provision of a dishwasher convection air inlet and suds control device which allows air to flow convectively upwardly through the chimney in the washing chamber and which allows suds to flow downwardly through the chimney into a collection cup.

The present invention achieves these objectives in a convection air inlet and suds control device for a dishwasher having a washing chamber with a bottom wall. The dishwasher also includes a chimney extending through the bottom wall with opposite upper and lower ends positioned on opposite sides of the bottom wall. A chimney cap is spaced in covering relation over the upper end of the chimney.

The device includes a large outer container attached to the bottom wall of the dishwashing chamber below the chimney. The outer container has a sidewall with at least one opening therein for permitting air to flow by convection into the outer container and upwardly through the chimney. An inner container is positioned within the outer container and underneath the chimney so as to enclose the downwardly extending lower end of the chimney. The upper end of the inner container is below the upper end of the outer container. When the washing chamber is in an oversudsing condition, suds flow downwardly through the chimney into the inner container. As the inner container fills with suds, the suds spill over the upper end of the inner container into the outer container. The suds condense in the inner container and change to liquid. When the liquid level rises to an elevation slightly above the lower end of the chimney, downward flow of suds and upper flow of air will be stopped until the liquid evaporates to an elevation below the lower end of the chimney.

DESCRIPTION OF PREFERRED EMBODIMENT

Figure 1:
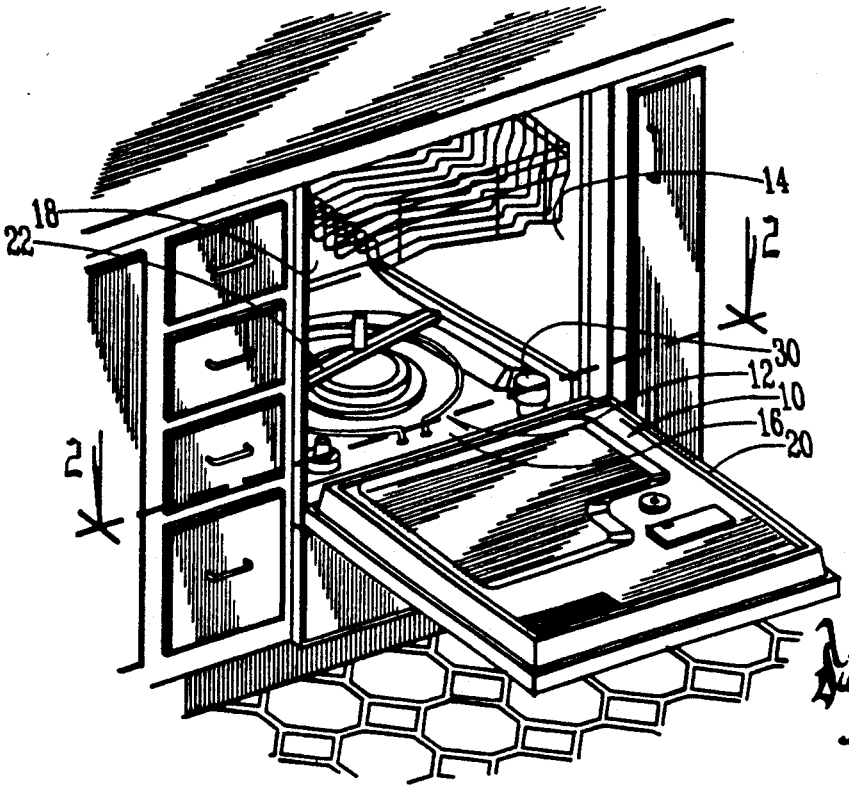
FIG. 1 is a perspective view of a dishwasher having the door in an open position.

Referring to the drawings, the reference numeral 10 generally designates a dishwasher. The dishwasher has a washing chamber or tub 12 defined by opposite side walls 14, a top wall (not shown), a bottom wall 16, a back wall 18, and a door 20. A rotating water spray arm 22 is operatively mounted in the bottom of the washing chamber 12.

Figure 4:
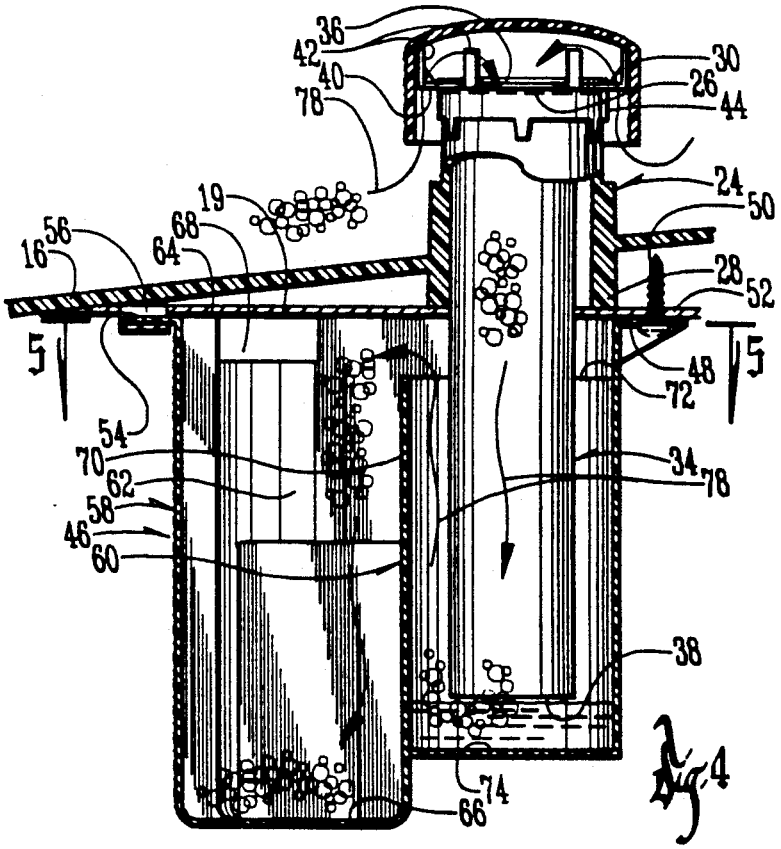
FIG. 4 is a sectional view taken along lines 4—4 of FIG. 2.
Figure 2:
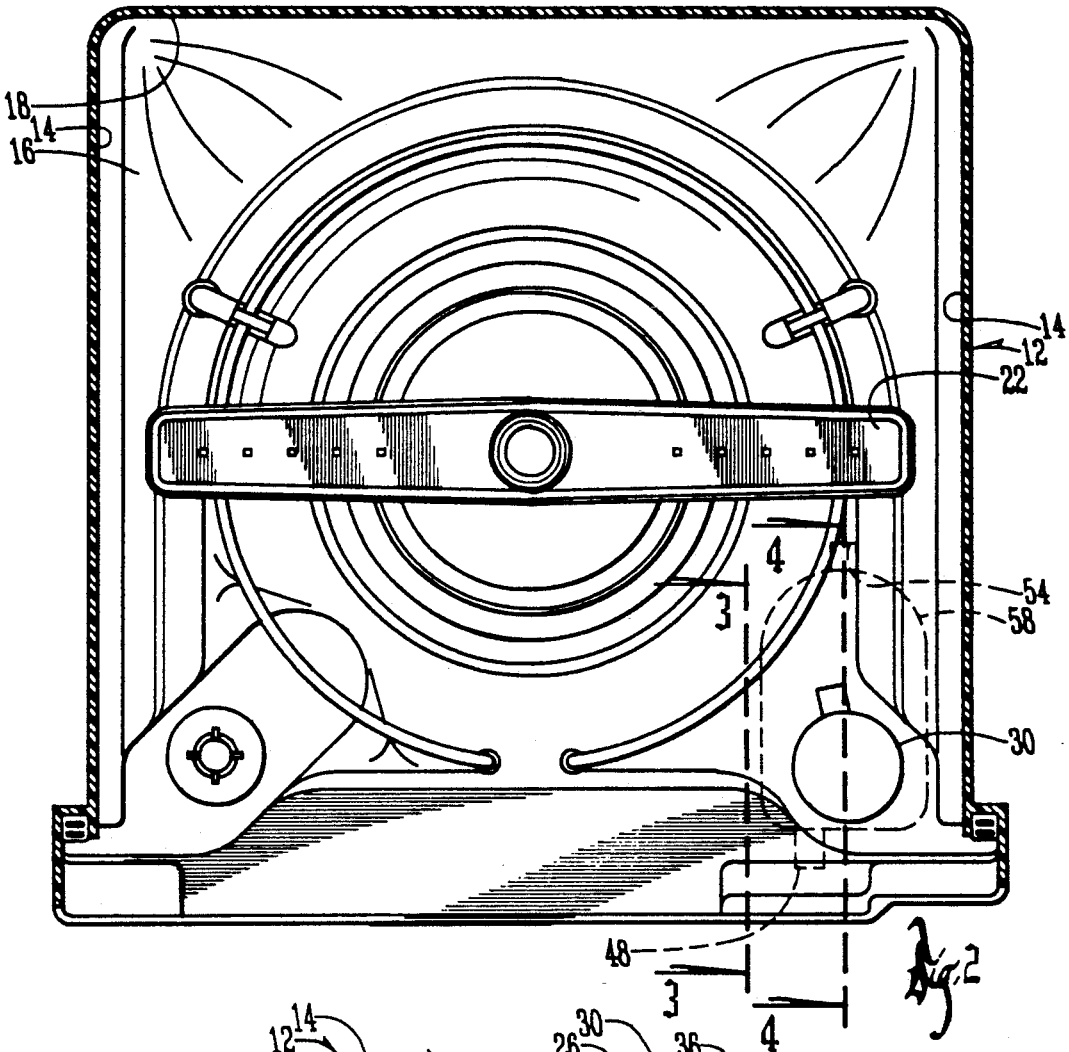
FIG. 2 is a sectional view taken along lines 2—2 of FIG. 1.
Figure 3:
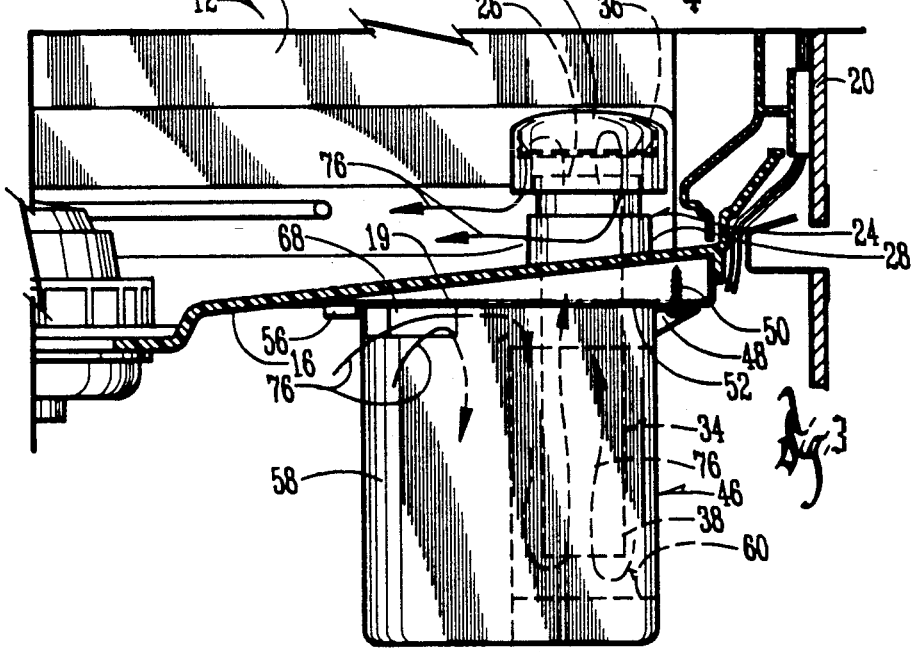
FIG. 3 is a sectional view taken along lines 3—3 of FIG. 2, showing the air inlet and suds control device of the present invention.
Figure 5:
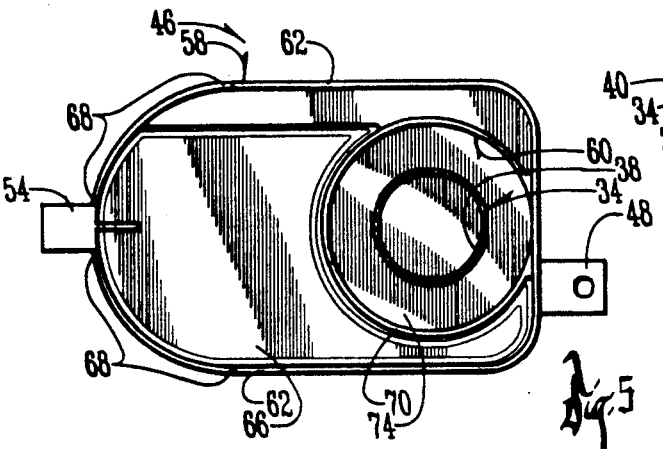
FIG. 5 is a sectional view taken along lines 5—5 of FIG. 4.

As best seen in FIGS. 3 and 4, a chimney 24 extends through the bottom wall 16. The chimney 24 includes an open upper end 26 located above the bottom wall 16 and an open lower end 28 located below the bottom wall. A chimney cap or cover 30 is in spaced covering relation over the upper end 26 of the chimney 24. The cap 30 includes a tab 32 for securing the cap to the bottom wall 16 of the washing chamber 12 with a screw (not shown).

An inlet tube 34 defines a chimney extension. The upper end 36 of the tube 34 is positioned above the upper end 26 of the chimney 24, and the lower end 38 of the tube 34 is positioned below the lower end 28 of the chimney 24. The upper end 36 of the inlet tube 34 includes a flange or splash guard 40 extending radially outwardly therefrom so as to minimize the entry of splashing water into the inlet tube 34. A plurality of spaced apart fingers 42 extend upwardly from the perimeter edge of the splash guard 40 so as to register with the inner peripheral surface of the chimney cap 30, as best seen in FIG. 4. Annular flange 44 extends downwardly from the splash guard 40 for positioning the inlet tube 34 over the upper end 26 of the chimney 24.

It is understood that the inlet tube 34 is provided as a retrofit component to provide a chimney extension on current chimney designs. Alternatively, the chimney could be redesigned and manufactured with at least the lower extension effectively equivalent to the lower end 38 of the inlet tube 34.

A receptacle or container 46 is mounted to the bottom wall 16 of the washing chamber 12 so as to be located under the chimney 24. The container 46 includes a first tab 48 having a hole for receiving a screw 50 which is threadably received in a portion or extension 52 of the tub support 19, as seen in FIG. 4. A second tab 54 is provided on the container 46 for receipt in a slot 56 in the portion 52 of the tub support 19.

Figure 6:
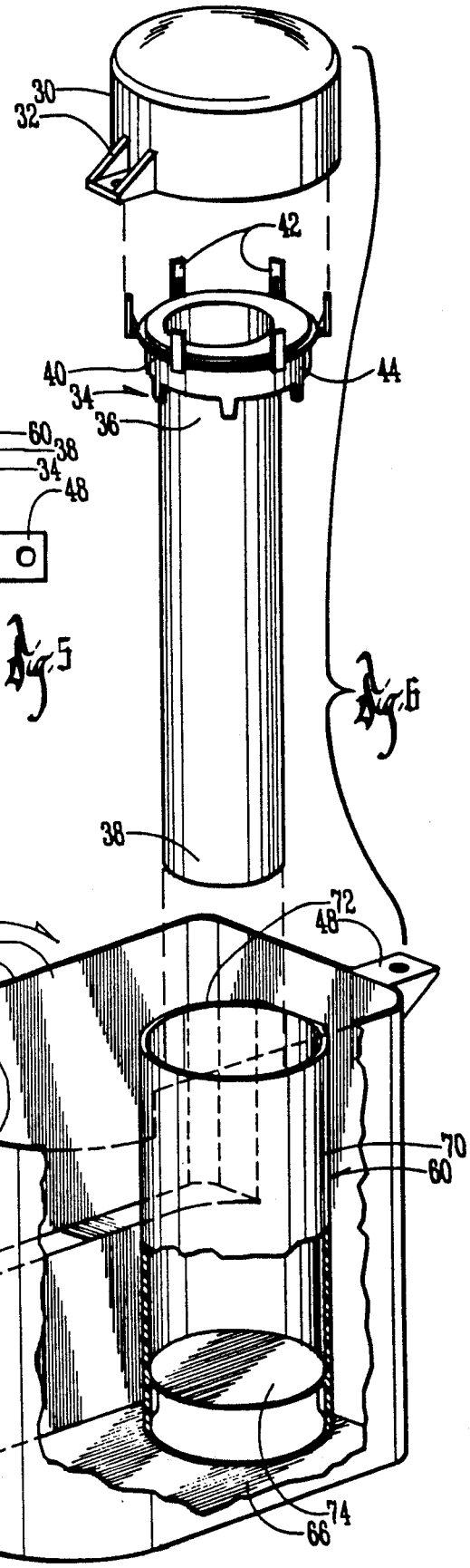
FIG. 6 is an exploded perspective view of the air inlet and suds control device of the present invention.

The container 46 includes a large outer cup 58 with a smaller inner cup 60 mounted therein. The outer cup 58 includes a side wall 62 with an upper end 64 and a bottom wall 66. At least one opening 68 is provided in the side wall 62 such that the outer cup 58 is open to the atmosphere whereby air may flow by convection into the outer cup 58, into inner cup 60 and upwardly through the chimney extension defined by the inlet tube 34 and thus into the washing chamber 12. The inner cup 60 includes a side wall 70 with an upper end 72 and a bottom wall 74. The upper end 72 of the inner cup is below the upper end 64 of the outer cup 58, as seen in FIGS. 4 and 6. The side wall 70 of the inner cup 60 surrounds the inlet tube 34, with the bottom wall 74 of the inner cup 60 being spaced below the lower end 38 of the inlet tube 34, as seen in FIG. 4.

During the drying cycle of the dishwasher operation, air flows by convection into the opening 68 in the outer cup 58, into the inner cup 60 and then upwardly through the inlet tube 34 and chimney 24 for entry into the washing chamber 12 so as to effect drying of the articles contained in the dishwasher 10. The flow of air is represented by arrows 76 in FIG. 3.

During operation of the dishwasher, if an oversudsing condition is encountered, suds may rise above the upper end of the chimney extension inlet tube 34 so as to flow downwardly through the tube 34. The suds are received in the inner cup 60. If the suds fill the inner cup 60, excess suds will spill over the upper end 72 of the inner cup 60 and into the outer cup 58. The suds flow is represented by arrows 78 in FIG. 4. Since the suds contain a high percentage of water, condensation of the suds creates a liquid level in the bottom of the inner cup 60. If the liquid level rises to an elevation slightly above the lower end 38 of the inlet tube 34, the flow of suds into the inner cup 60 is stopped due to the water pressure. Thus, the inner cup 60 and the lower end 38 of the inlet tube 34 cooperate to form a valve to control the flow of suds. Eventually, the liquid in the inner cup 60 will evaporate such that the flow of suds into the inner cup 60 can resume. Suds spilling over into the outer cup 58 will also condense into liquid, which will ultimately evaporate.

When the liquid level in the inner cup 60 is above the lower end 38 of the inlet tube 34, air flow into the inlet tube 34 and the chimney 24 is also prevented. Once the liquid evaporates, the convection drying operation will return to normal. Alternatively, a weep hole (not shown) may be provided in the inner cup 60 to slowly bleed off the liquid into the outer cup 58 so as to allow for normal drying operation, without any shut-off valve effect created by liquid in the inner cup 60.

The preferred embodiment of the invention has been set forth in the drawings and the specification, and although specific terms are employed, these are used in generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

From the foregoing, it can be seen that the present invention accomplishes at least all of the stated objectives.

What is claimed is:

1. An air inlet and suds control device for a dishwasher having a washing chamber with a bottom wall, a chimney extending through the bottom wall with opposite upper and lower open ends positioned on opposite sides of the bottom wall, and a chimney cap spaced in covering relation over the upper end of the chimney, the device comprising:

a receptacle mounted below the bottom wall of the washing chamber and being positioned underneath the lower end of the chimney so as to receive suds entering the upper end of the chimney and flowing downwardly through the chimney;

the receptacle being open to the atmosphere such that air may flow by convection into the receptacle and upwardly through the chimney and into the washing chamber.

2. The device of claim 1 wherein the receptacle has a sidewall with an open upper end and a closed lower end, the sidewall having at least one opening therein for the convection flow of air into the receptacle.

3. The device of claim 2 wherein the receptacle includes an inner cup positioned underneath the chimney so as to receive suds passing downwardly through the chimney.

4. The device of claim 3 wherein the inner cup has an open upper end positioned below the upper end of the receptacle, whereby suds overfilling the inner cup will overflow into the receptacle.

5. The device of claim 1 wherein the receptacle includes a large chamber and a small chamber positioned within the large chamber, the small chamber being underneath the chimney so as to receive suds flowing downwardly therethrough, and such that suds overflowing the small chamber are received in the large chamber.

6. The device of claim 1 further comprising an inlet tube extending downwardly from the chimney and having a lower end extending into the receptacle, such that the inlet tube allows air to flow by convection upwardly therethrough until such time that liquid resulting from condensing suds in the receptacle rises to a level in the receptacle above the lower end of the inlet tube.

7. The device of claim 6 wherein the inlet tube extends above the chimney and terminates in an open upper end, the inlet tube having a splash guard extending radially outwardly therefrom at a position above the upper end of the chimney, so as to minimize splashing of wash water into the inlet tube.

8. The device of claim 6 wherein the chimney cap is cup-shaped and has a wall defining interior and exterior perimeter surfaces, and the inlet tube has a plurality of fingers extending upwardly from the upper end thereof so as to substantially matingly engage with the interior perimeter surface of the cap.

9. An air inlet for a dishwasher having a washing chamber with a bottom wall, the dishwasher washing chamber including a chimney with portions extending upwardly and downwardly through the bottom wall and terminating in open upper and lower ends, and a chimney cover spaced in covering relationship over the upper end of the chimney, the air inlet comprising:

a first container surrounding the downwardly extending portion of the chimney and including a bottom wall spaced below the open lower end of the chimney, the upper periphery of the first container being substantially open to atmosphere; and a second container substantially surrounding the first container, the second container being mounted to the washing chamber bottom wall and including a side wall having an open portion defining an air flow path for atmospheric air to convectively enter the second container, the first container, the chimney and the washing chamber to effect the drying of dishes.

10. The air inlet of claim 9 wherein the first and second containers each have an upper end, the upper end of the first container being at a lower elevation than the upper end of the second container, whereby suds flowing from the washing chamber and into the chimney will be received in the first container until the first container is filled, and the suds will spill over the upper end of the first container into the second container.

11. The air inlet of claim 10 wherein the lower end of the chimney defines a normally open valve allowing air to flow by convection upwardly through the chimney and allowing suds to flow downwardly into the first container, the valve being closed to prevent flow in either the upward or downward direction when liquid deriving from suds condensing in the first container rises to a level above the lower end of the chimney.

12. A suds suppressing air inlet for a dishwasher having a washing chamber with a bottom wall, the dishwasher washing chamber including a chimney with portions extending upwardly and downwardly through the bottom wall and terminating in open upper and lower ends respectively, and a chimney cover spaced in covering relation over the open upper end of the chimney, the air inlet comprising:

an outer cup surrounding the downwardly extending portion of the chimney and adjacent to said bottom wall, the outer cup including a side wall having an opening to atmosphere for permitting air to enter the chimney;

an inner cup surrounded by the outer cup and having an open top spaced below the washing chamber bottom wall, the inner cup enclosing the downwardly extending portion of the chimney and including a bottom wall spaced below the open lower end of the chimney, the air inlet defining a flow path for suds escaping from the washing chamber in an oversudsing condition, the inner cup providing surface contact area for condensing suds into liquid to bridge the space between the inner cup bottom wall and the open lower end of the chimney for stopping the flow of suds from the washing chamber.

13. The air inlet of claim 12 wherein the inner and outer cups each have an upper end, the upper end if the inner cup being at a lower elevation than the upper end of the outer cup, whereby suds flowing from the washing chamber and into the chimney will be received in the inner cup until the inner cup is filled, and the suds will spill over the upper end of the inner cup into the outer cup.

* * * * *